US005751204A

United States Patent [19]

Chen

[11] Patent Number: 5,751,204

[45] Date of Patent: May 12, 1998

[54] PROTECTIVE CASING FOR NON-SHEATHING TRANSFORMER

[76] Inventor: James Chen, 3F, No. 15, Lane 50, Nankang Road, Section 3, Taipei, Taiwan

[21] Appl. No.: 690,397

[22] Filed: Jul. 26, 1996

[51] Int. Cl.[6] ..... H01F 27/02

[52] U.S. Cl. ..... 336/98

[58] Field of Search ..... 336/98, 90; 174/92

[56] References Cited

U.S. PATENT DOCUMENTS

| | | | |
|---|---|---|---|
| 2,894,056 | 7/1959 | Bogese | 174/90 |
| 3,147,338 | 9/1964 | Ekvall et al. | 174/92 |
| 3,634,605 | 1/1972 | Dola | 174/92 |
| 3,757,031 | 9/1973 | Izraeli | 174/92 |
| 4,029,896 | 6/1977 | Skinner | 174/92 |
| 4,049,357 | 9/1977 | Hamisch, Jr. | 174/92 |
| 4,206,435 | 6/1980 | Harris et al. | 336/98 |
| 4,363,014 | 12/1982 | Leach et al. | 336/90 |

FOREIGN PATENT DOCUMENTS

| | | | |
|---|---|---|---|
| 2201840 | 9/1988 | United Kingdom | 336/176 |

*Primary Examiner*—Thomas J. Kozma
*Attorney, Agent, or Firm*—Bacon & Thomas

[57] ABSTRACT

A protective casing for a non-sheathing transformer has two downward extended arms suitable for inserting into two spaces between two lateral sides of a coil and two lateral inner edges of a steel core frame of the transformer and be retained thereto by two hook portions provided at lower ends of the arms, such that the protective casing is firmly covered over the non-sheathing transformer to protect the exposed coil thereof against any external damage.

1 Claim, 4 Drawing Sheets

PROTECTIVE CASING FOR NON-SHEATHING TRANSFORMER

BACKGROUND OF THE INVENTION

Among various types of transformer, there is a non-sheathing transformer which has small dimensions and is widely used in different applications, such as for plugging in a PC board. Such non-sheathing transformer usually has a steel core frame which includes an outer square frame and a middle bar across the outer square frame for a coil to wind around. The non-sheathing transformer looks like a steel core frame having a convexo-convex coil body with four output ends projected from four corners of a top surface thereof. Such transformer is inconvenient in use and tends to be damaged because the projected output ends at four corners are easily broken and the exposed coil is easily punctured and damaged during manufacturing, assembly, or even at the time a card is plugged in a computer, for example. Up to now, there is no resolution to this disadvantage in conventional non-sheathing transformers. Glue or the like has been used on the projected output ends to somewhat blunt the terminals. However, this solution is of little help and not economical in view of the additional manufacturing and labor costs. On the other hand, since the non-sheathing transformer has limited dimensions to meet the requirement of an electric circuit, any additional cover for covering the whole transformer will inevitably increase the volume of the transformer and accordingly affect its use in the whole circuitry. This is the main factor which prevents the problem with the non-sheathing transformer from being efficiently solved.

SUMMARY OF THE INVENTION

A primary object of the present invention is to provide a protective casing for a non-sheathing transformer to protect the transformer from external damage. The protective casing according to the present invention is generally a hollow cover preferably made of plastic material by means of injection molding. The casing is provided at each of two opposite sides with a downward extended arm. Each arm has a proper length and has an outward projected hook portion formed at a lower edge thereof. When the casing is covered over the transformer, the arms separately insert into two narrow spaces between two sides of an inner coil and an outer steel core frame surrounding the coil with the hook portions being retained on a lower edge of the steel core frame. The protective casing is thereby firmly covered over the transformer to shield the exposed coil and the output ends. The protective casing of the present invention is easy in operation and without occupying additional space to affect the use of the transformer itself.

DETAILED DESCRIPTION OF THE PREFERRED EMBODIMENT

Figure 1:
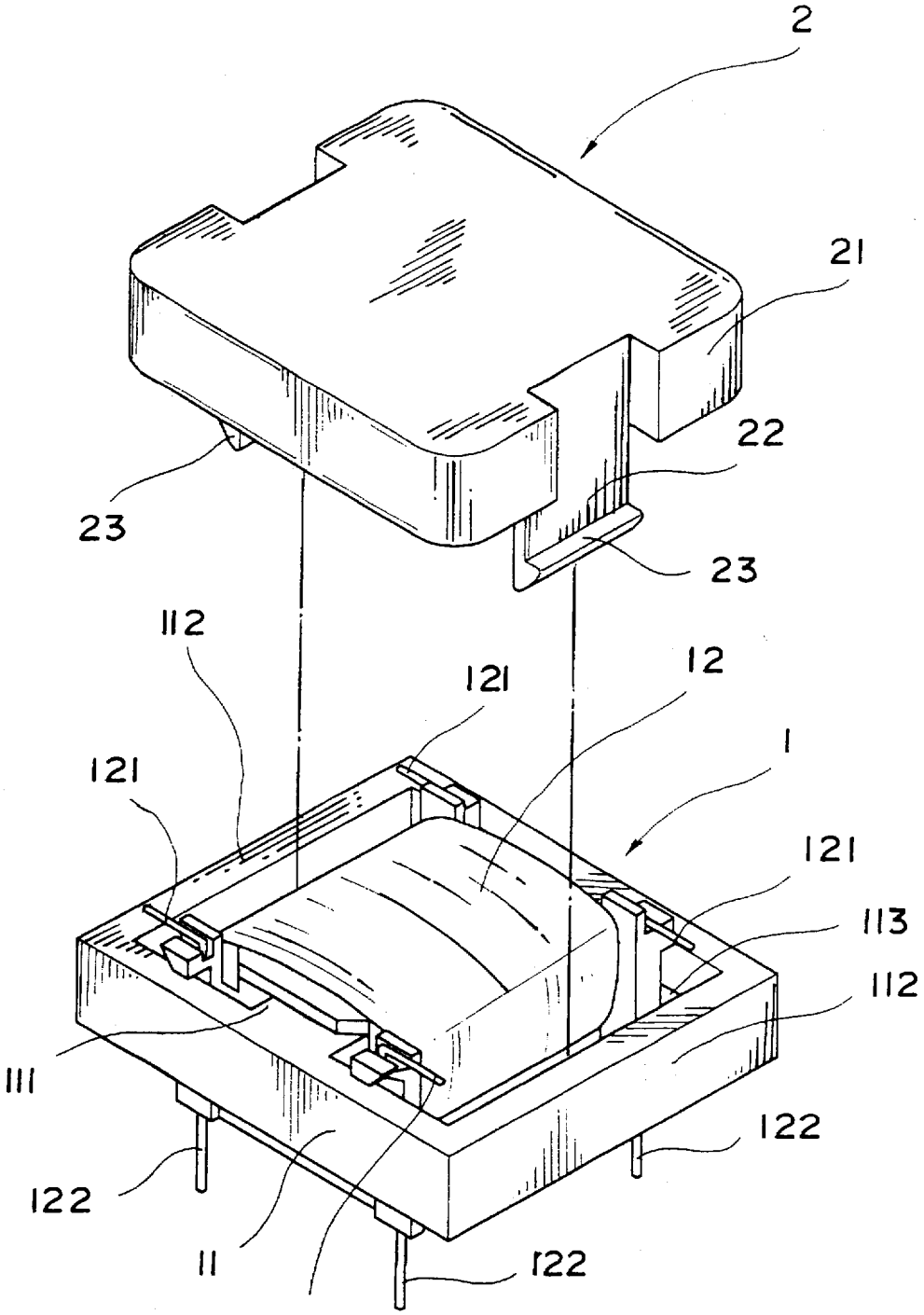
FIG. 1 is an exploded perspective view showing a non-sheathing transformer and a protective casing according to the present invention.
Figure 2:
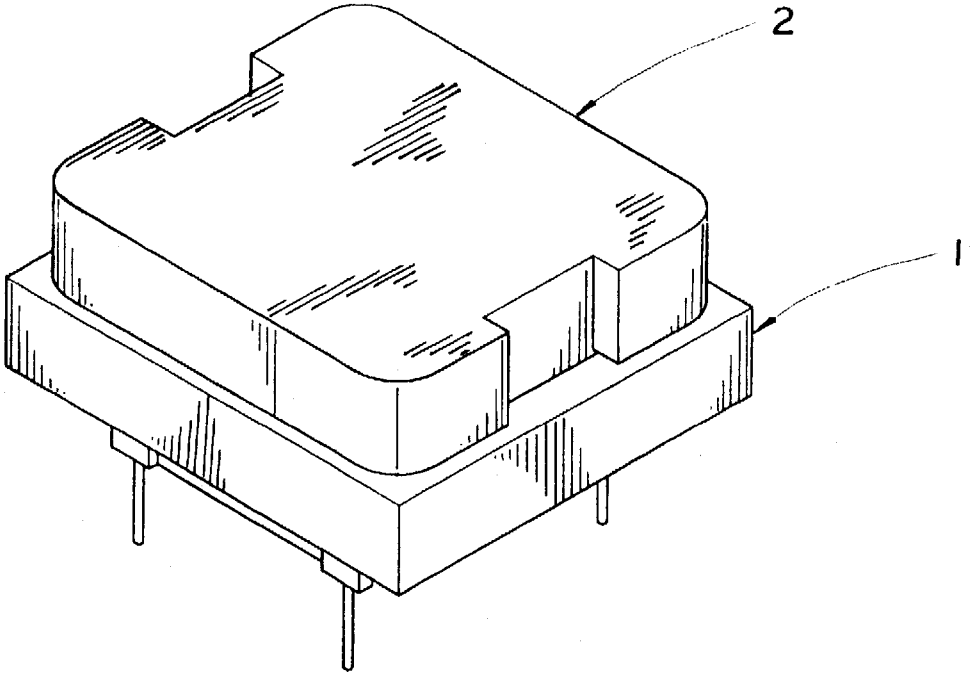
FIG. 2 is an assembled perspective view of the transformer and the protective casing shown in FIG. 1.

Please refer to FIGS. 1 through 4. The present invention relates to a protective casing 2 for a non-sheathing transformer 1. Generally, the non-sheathing transformer 1 includes a square steel core frame 11 and a coil 12. The coil 12 is usually coated with a thin protective layer and has output ends 121 near four corners thereof. Pins 122 are provided at a bottom of the transformer 1. The steel core frame 11 includes a middle bar 111 for the coil 12 to wind around and four outer frame portions 112. Two spaces 113 are left between two lateral sides of the coil 12 and two opposite lateral frame portions 112 of the steel core frame 11.

Figure 3:
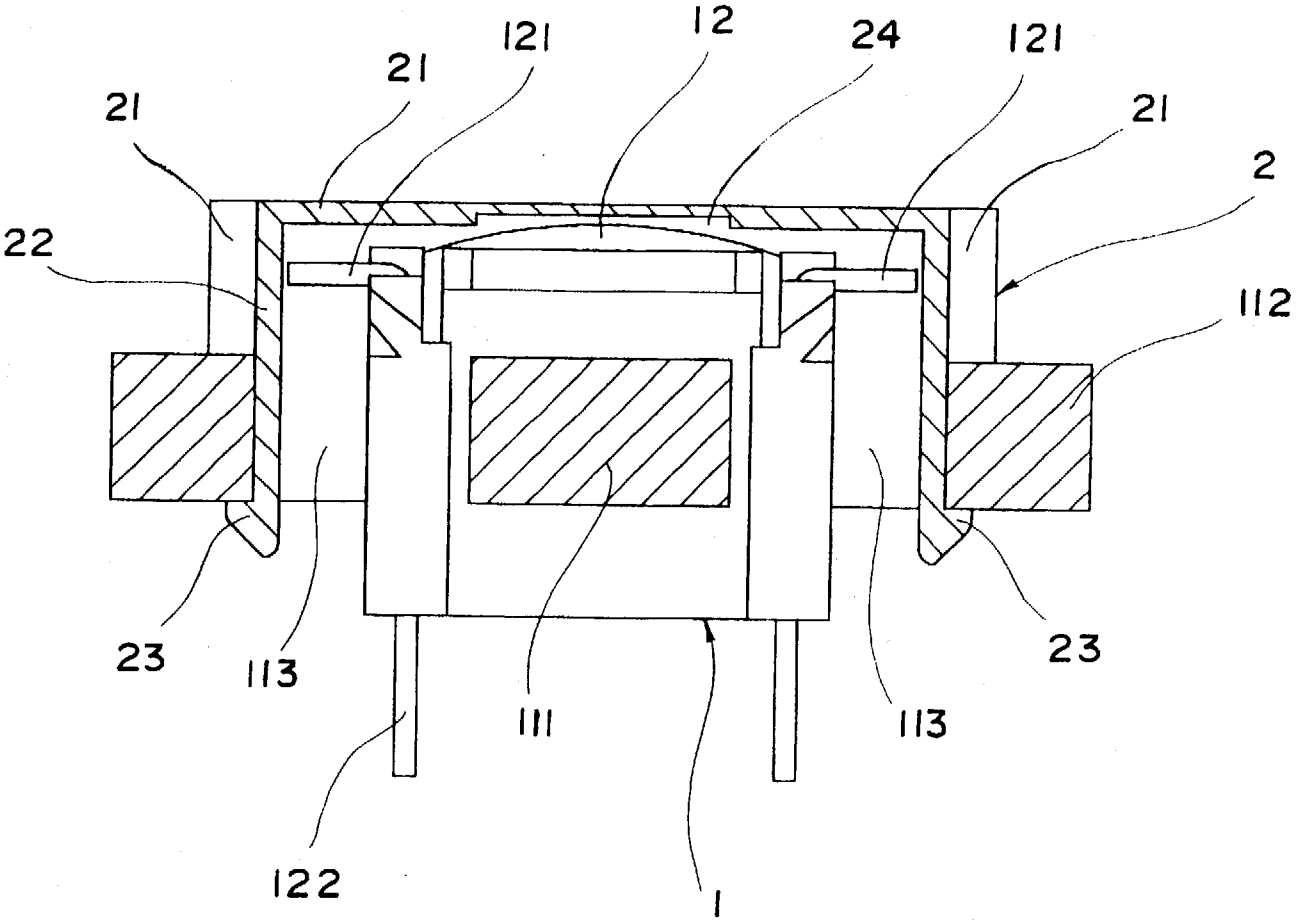
FIG. 3 is a side sectional view of the assembled transformer and protective casing of FIG. 2.
Figure 4:
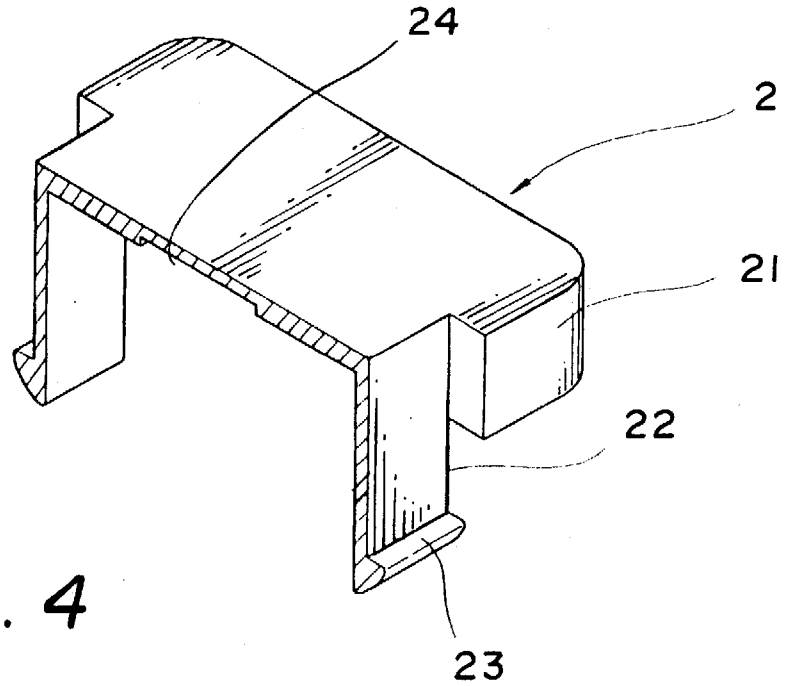
FIG. 4 is a fragmentary, perspective view of the protective casing, wherein a part of which is removed for clearly illustrating the structure thereof.

The protective casing 2 is substantially a hollow cover including a square cover portion 21 and two arms 22. The cover portion 21 has a size slightly smaller than that of the steel core frame 11, so that it will not project from any side of the steel core frame 11 when it is covered over the non-sheathing transformer 1. The cover portion 21 is provided at two opposite outer sides corresponding to the two spaces 113 each with a recess in an adequate depth. From the recesses, the two arms 22 extend downward to a proper length. Each arm 22 is provided at a lower end with an outward projected hook portion 23. The arms 22 are somewhat flexible and are located corresponding to the two spaces 113 of the non-sheathing transformer 1, whereby when the protective casing 2 is covered over the non-sheathing transformer 1, the arms 22 just insert into the spaces 113 to abut against an inner wall surface of each of the two corresponding frame portions 112 of the steel core frame 11. The length of the arms 22 is about the same as the height of the frame portions 112 of the steel core frame 11, allowing the hook portions 23 of the arms 22 to engage and be retained on lower edges of the frame portions 112, as shown in FIG. 3. By this way, the protective casing 2 is firmly covered over the non-sheathing transformer 1 to shield the exposed coil 12.

Since the protective casing 2 has an adequate proper thickness which allows a thinned portion 24 to be formed at an inner top wall surface of the casing 2, an inner space as large as possible can be provided by the casing 2 to accommodate all components of the transformer 1 located at an upper portion thereof, including the coil 12 and the output ends 121.

Since the protective casing 2 has dimensions well matching with that of the non-sheathing transformer 1, it will not occupy any additional space while it is inserted into the transformer 1 to form a united assembly with the transformer 1, and it will not adversely affect the convenient use of the transformer 1.

The protective casing 2 can be integrally formed from plastic material by means of injection molding at a very low manufacturing cost. In addition, the casing 2 can be easily operated without difficulty.

Although the present invention has been described with the preferred embodiment thereof, it should be noted that the present invention is not limited to such embodiment and various changes can be made to, for example, the arms or the shape of the hook portions thereof, without departing from the spirit of the present invention or the scope of the subjoined claim.

What is claimed is:

1. A casing and transformer assembly comprising:

a) a transformer including a steel core frame formed by a plurality of lateral frame portions defining an outer periphery of the frame, a coil means supported within the frame and having a pair of lateral sides, and a pair of spaces, each space being positioned between each lateral side of the coil means and a frame portion;

b) a protective casing including a hollow cover portion, a pair of arms extending downwardly from the cover portion, each arm terminating in an outwardly directed hook portion, the arms being insertable through the spaces into abutting engagement with the frame and the hooks being in engagement with a lower edge of the frame for retaining the casing to the transformer and enclosing the coil means within the hollow cover portion; and c) the casing being of sufficient size to fully enclose and shield the coil means but not project outwardly beyond the outer periphery of the steel core frame, thereby occupying substantially the same space as that occupied by the transformer without the casing.

* * * * *